United States Patent [19]

Sekiya et al.

[11] 4,406,258

[45] Sep. 27, 1983

[54] HELICALLY-SHAPED INTAKE PORT OF AN INTERNAL COMBUSTION ENGINE

[75] Inventors: Setsuro Sekiya; Katsuhiko Motosugi; Hiroshi Takahashi, all of Toyota, Japan

[73] Assignee: Toyota Jidosha K.K., Toyota, Japan

[21] Appl. No.: 304,597

[22] Filed: Sep. 22, 1981

Related U.S. Application Data

[63] Continuation of Ser. No. 44,406, Jun. 1, 1979, abandoned.

[30] Foreign Application Priority Data

Sep. 19, 1978 [JP] Japan ..... 53-127516

[51] Int. Cl.[3] ..... F01L 3/00

[52] U.S. Cl. ..... 123/188 M; 123/306

[58] Field of Search ..... 123/52 M, 188 M, 306

[56] References Cited

U.S. PATENT DOCUMENTS

| | | | |
|---|---|---|---|
| 3,273,551 | 9/1966 | Julian et al. | 123/188 M |
| 3,335,707 | 8/1967 | Heinrich | 123/80 |
| 3,408,994 | 11/1968 | Kraus | 123/188 M |

FOREIGN PATENT DOCUMENTS

| | | | |
|---|---|---|---|
| 1956351 | 5/1971 | Fed. Rep. of Germany | 123/188 M |
| 2122942 | 12/1971 | Fed. Rep. of Germany | 123/188 M |
| 2242383 | 3/1974 | Fed. Rep. of Germany | 123/188 M |
| 2643648 | 7/1977 | Fed. Rep. of Germany | 123/188 M |
| 192366 | 11/1964 | Sweden | 123/188 M |
| 1259484 | 1/1972 | United Kingdom | 123/188 M |

*Primary Examiner*—Craig R. Feinberg
*Assistant Examiner*—W. R. Wolfe
*Attorney, Agent, or Firm*—Kenyon & Kenyon

[57] ABSTRACT

A helically-shaped intake port comprising a helical portion and an inlet passage portion which is tangentially connected to the helical portion and extends so as to be slightly curved. The intake valve is arranged at the outlet open end of the helical portion. The first side wall of the inlet passage portion, which is located near the axis of the intake valve, has on its upper portion an inclined wall portion which is arranged to be directed downwards. The inlet passage portion has an open inlet end formed on the flat side wall of the cylinder head. The inlet passage portion is so arranged that the longitudinal axis thereof obliquely intersects with a straight line passing through the center of the valve head of the intake valve and extending parpendicular to the outer side wall of the cylinder head. The inlet end of the inlet passage portion is arranged at a position remote from the straight line so that the inlet end does not include the straight line.

13 Claims, 9 Drawing Figures

HELICALLY-SHAPED INTAKE PORT OF AN INTERNAL COMBUSTION ENGINE

This is a continuation of application Ser. No. 44,406 filed June 1, 1979 now abandoned.

DESCRIPTION OF THE INVENTION

The present invention relates to a helically-shaped intake port of an internal combustion engine.

Particularly in a compression-ignition type internal combustion engine, in order to create a strong swirl motion in the combustion chamber of the engine at the time of the intake stroke, a helically-shaped intake port comprising a substantially straight inlet passage portion and a helical portion is used. However, even if such a helically-shaped intake port is applied to a spark-ignition type gasoline engine and, in addition, a slight change of the construction of the helically-shaped intake port is effected so as to create a swirl motion of the strength necessary to obtain a good combustion when an engine is operating under a light load, since the engine speed normally used in a gasoline engine is considerably greater than that normally used in a compression-ignition type engine, the flow resistance to which the mixture flowing in the helically-shaped intake port is subjected becomes large. As a result of this, a problem occurs in which the volumetric efficiency is reduced when a gasoline engine is operating at a high speed under a heavy load.

An object of the present invention is to provide helically-shaped intake port having a novel construction which is capable of creating a strong swirl motion in the combustion chamber when the engine is operating under a light load, while ensuring a high volumetric efficiency when the engine is operating at a high speed under a heavy load.

According to the present invention, there is provided an internal combustion engine having a cylinder and a cylinder head which forms a helically-shaped intake port therein and has a substantially vertically extending flat outer side wall, the helically-shaped intake port comprising a helical portion having an open outlet end and an intake valve having a valve head at the outlet end. The helical portion is defined by an upper wall and a peripheral side wall which extends circumferentially about an axis of the intake valve. An axially extending inlet passage portion is tangentially connected to the helical portion and has an open inlet end formed on the outer side wall of the cylinder head. The inlet passage portion is defined by an upper wall, a bottom wall, a first side wall arranged at a position near the axis of the intake valve, and a second side wall arranged at a positon remote from the axis of the intake valve and connected to the peripheral side wall of the helical portion, the inlet passage portion being so arranged that the longitudinal axis thereof obliquely intersects a straight line passing through the center of the valve head of the intake valve and extending parpendicular to the outer side wall of the cylinder head. The inlet end of the inelt passage portion is arranged at a position remote from the straight line so that the inlet end does not include the straight line.

The present invention may be more fully understood from the description of a preferred embodiment of the invention set forth below, together with the accompanying drawings.

DESCRIPTION OF A PREFERRED EMBODIMENT

Figure 1:
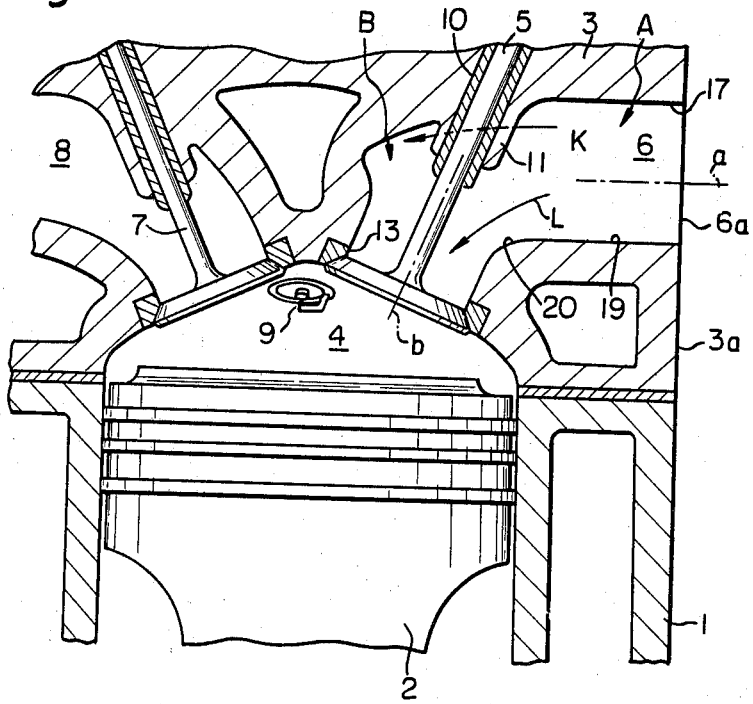
FIG. 1 is a cross-sectional side view of a fragment of an internal combustion engine according to the present invention.
Figure 2:
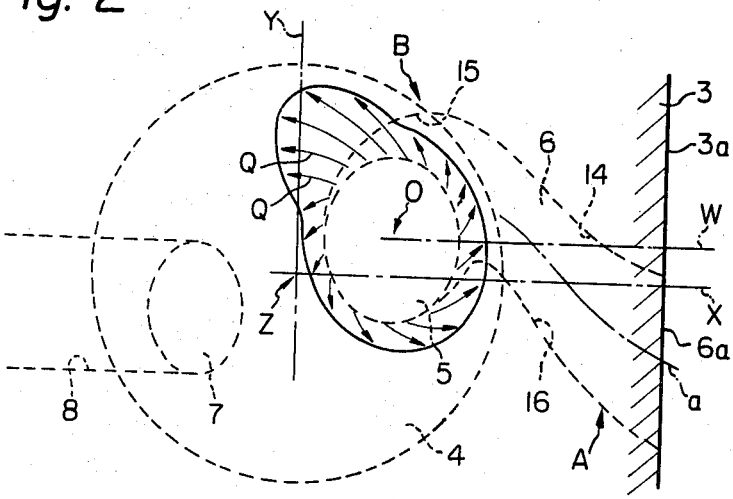
FIG. 2 is a plan view of a fragment of the engine illustrated in FIG. 1.
Figure 3:
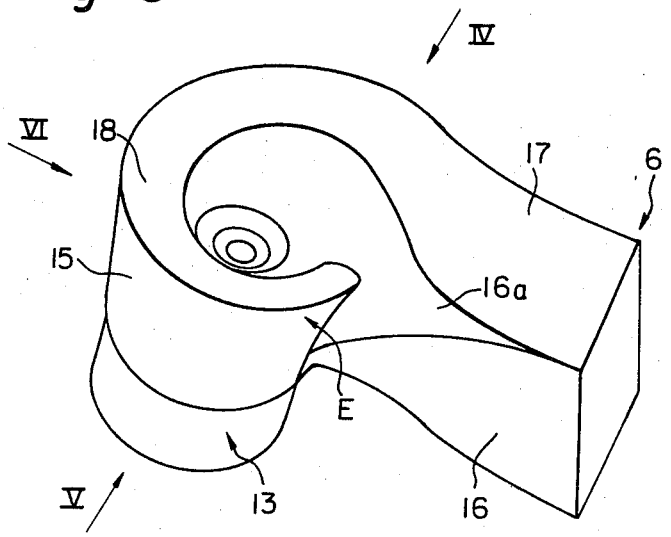
FIG. 3 is a perspective view of a helical shaped intake port schematically illustrating the helical shaped intake port illustrated in FIG. 1.

The structure shown in FIGS. 1 and 2 includes a cylinder block 1 a piston 2 reciprocally movable in the cylinder block 1, a cylinder head 3 fixed onto the cylinder block 1 and a combustion chamber 4 formed between the piston 2 and the cylinder head 3. The structure also includes an intake valve 5 located at the end of a helically-shaped intake port 6 formed in the cylinder head, an exhaust valve 7, an exhaust port 8, and a spark plug 9. The intake port 6 has an open inlet end *6a* formed on the flat outer side wall *3a* of the cylinder head 3, and an intake manifold (not shown) is connected to the inlet end *6a* of the intake port 6. As is illustrated in FIG. 1, a valve guide 10 is supported in a cylindrical projection 11 formed in one piece and extending downwardly from the upper inner wall of the helically-shaped intake port 6, and the tip of the valve guide 10 projects from the tip of the cylindrical projection 11. At the time of the intake stroke, the mixture formed in the carburetor (not shown) is introduced into the combustion chamber 4 via the helically-shaped intake port 6 and the intake valve 5, and then the mixture is ignited by the spark plug 9 at the end of the compression stroke.

Figure 4:
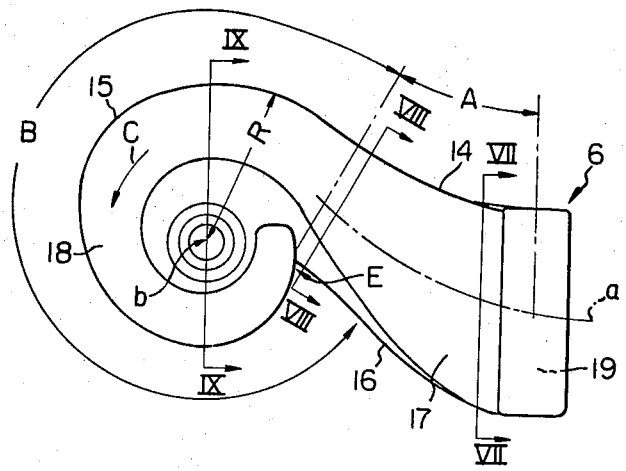
FIG. 4 is a plan view in the direction of the arrow IV in FIG. 3.
Figure 5:
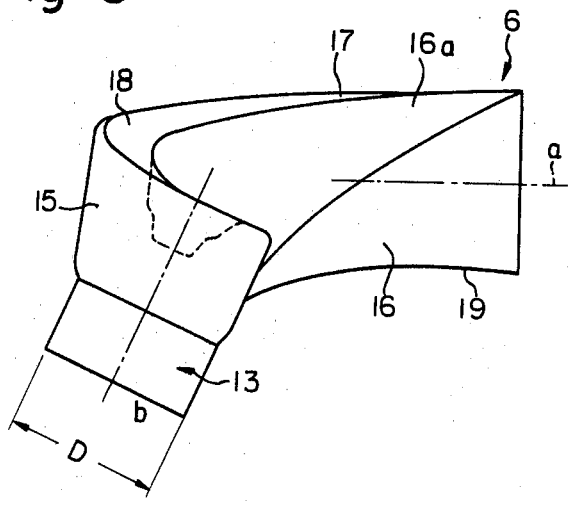
FIG. 5 is a side view in the direction of the arrow V in FIG. 3.
Figure 6:
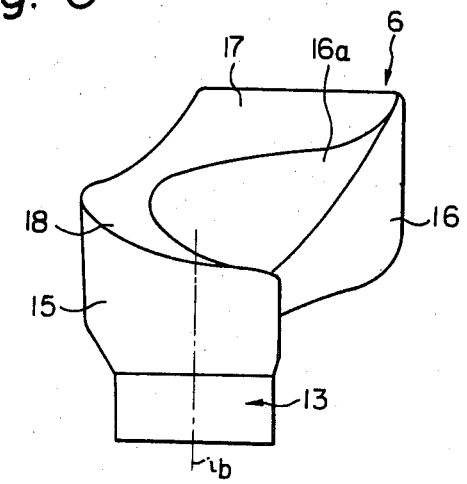
FIG. 6 is a side view in the direction of the arrow VI in FIG. 3.
Figure 7:
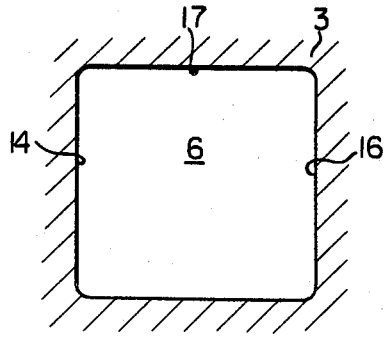
FIG. 7 is a cross-sectional view taken along the line VII—VII in FIG. 4.
Figure 9:
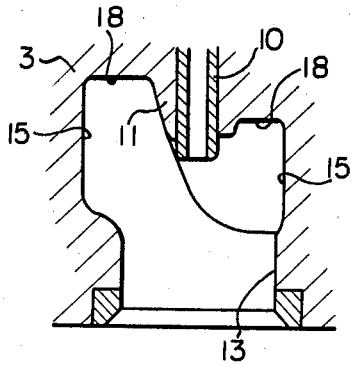
FIG. 9 is a cross-sectional view taken along the line IX—IX in FIG. 4.

FIGS. 3 through 6 schematically illustrate the shape of the helically-shaped intake port 6. As is illustrated in FIG. 4, the helically-shaped intake port 6 according to the present invention comprises an inlet passage portion A and a helical portion B, the longitudinal central axis of the inlet passage portion A being slightly curved. The inlet end *6a* of the inlet passage portion A has a rectangular cross-section as illustrated in FIG. 7, and the mixture outlet portion 13 of the helical portion B has a cylindrical inner wall which extends circumferentially about the helix axis b of the helical portion B. Alternatively, instead of forming the inlet end *6a* so that it has a rectangular cross-section, it may be so formed that it has a circular cross-section or an elliptical cross-section. As illustrated in FIG. 1, the helix axis b, that is, the axis of the intake valve 5, is inclined by approximately 23° with respect to the axis of the cylinder, and the inlet passage portion A extends substantially horizontally. The side wall 14 of the inlet passage portion A, which is located remote from the helix axis b, is arranged so as to be substantially vertical and is smoothly connected to the side wall 15 of the helical portion B, which extends circumferentially about the helix axis b. As illustrated in FIGS. 6 and 9, the side wall 15 of the helical portion B is so formed that it expands outwards from the cylindrical inner wall of the mixture outlet portion 13. In addition, as is illustrated in FIG. 4, the side wall 15 is so formed that the distance R between the side wall 15 and the helix axis b is maintained constant at a position near the inlet passage portion A and is gradually reduced towards the helical direction C. The distance R becomes approximately equal to the radius of the cylindrical inner wall of the mixture outlet portion 13 at the helix terminating portion E.

Figure 8:
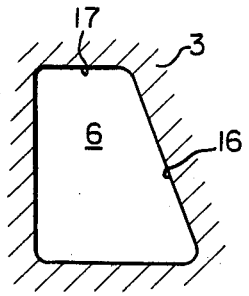
FIG. 8 is a cross-sectional view taken along the line VIII—VIII in FIG. 4.

The side wall 16 of the inlet passage portion A, which is located near the helix axis b, has on its upper portion an inclined wall portion 16*a* which is arranged to be directed downwards in the same manner as a corresponding inclined wall portion in the co-pending applications of Kiyoshi Nakanishi et al. Ser. No. 38,819, filed May 14, 1979, now abandoned and Ser. No. 40,046, filed May 17, 1979, now U.S. Pat. No. 4,312,309, both assigned to the assignee hereof. The width of the inclined wall portion 16*a* is gradually increased towards the helical portion B and, as is illustrated in FIG. 8, the entire portion of the side wall 16 is inclined at the connecting portion of the inlet passage portion A and the helical portion B. The upper part of the side wall 16 is smoothly connected to the circumferential wall of the cylindrical projection 11, and the lower part of the side wall 16 is connected to the side wall 15 of the helical portion B at the helix terminating portion E of the helical portion B.

As is illustrated in FIGS. 1 and 5, the upper wall 17 of the inlet passage portion A extends substantially horizontally from the inlet open end of the inlet passage portion A towards the helical portion B and is smoothly connected to the upper wall 18 of the helical portion B. This upper wall 18 gradually descends towards the helical direction C (FIG. 4) and is connected to the side wall 16 of the inlet passage portion A. Since the inclined wall portion 16*a* of the inlet passage portion A is so formed that the width thereof is gradually increased towards the helical portion B as mentioned above, the width of the upper wall 17 of the inlet passage portion A is gradually reduced. In addition, since the side wall 15 of the helical portion B is so formed that the distance R between the side wall 15 and the helical axis b is maintained constant at a position near the inlet passage portion A and is gradually reduced towards the helical direction C as mentioned above, the width of the upper wall 18 of the helical portion B is gradually reduced towards the helical direction C. Consequently, it will be understood that the upper wall 17 of the inlet passage portion A extends substantially horizontally towards the helical portion B, while the width of the upper wall 17 is gradually reduced, and that the upper wall 18 of the helical portion B gradually descends towards the helical direction C, while the width of the upper wall 18 is gradually reduced.

As is illustrated in FIGS. 1 and 5, the bottom wall 19 of the inlet passage portion A extends substantially horizontally in parallel with the upper wall 17 towards the helical portion B and is connected to the cylindrical inner wall of the mixture outlet portion 13 via a smoothly curved wall 20 as illustrated in FIG. 1. From FIG. 4, it will be understood that the width of the bottom wall 19 is gradually reduced towards the helical portion B.

As is illustrated in FIG. 2, if a straight line passing through the central axis Z of the cylinder and extending parpendicular to the outer side wall 3*a* of the cylinder head 3 is indicated by X, and if a straight line passing through the central axis Z of the cylinder and extending in parallel with the outer side wall 3*a* of the cylinder head 3 is indicated by Y, the intake valve 5 is so arranged that the central O of the valve head of the intake valve 5 is positioned within the region located above the straight line X on the right side of the straight line Y in FIG. 2. In addition, if a straight line passing through the center O of the valve head of the intake valve 5 and extending perpendicular to the outer side wall 3*a* of the cylinder head 3 is indicated by W, the inlet passage portion A is so arranged that the central axis A thereof obliquely intersects the straight line W, and that the inlet end 6*a* does not include the straight line W and is arranged below the straight line W in FIG. 2.

In operation, a part of the mixture introduced into the inlet passage portion A moves forward along the upper walls 17 and 18, as illustrated by the arrow K in FIG. 1, and the remaining part of the mixture impinges upon the inclined wall portion 16*a* and is deflected downwards. As a result, the remaining part of the mixture flows into the mixture outlet portion 13 without swirling, as illustrated by the arrow L in FIG. 1. Since the widths of the upper walls 17 and 18 are gradually reduced towards the flow direction of the mixture as mentioned above, the cross-section of the flow path of the mixture flowing along the upper walls 17 and 18 is gradually reduced along the flow direction of the mixture. In addition, since the upper wall 18 gradually descends towards the helical direction C, the mixture flowing along the upper walls 17 and 18 is deflected downwards, while the velocity thereof is gradually increased. As a result of this, a swirl motion moving downwards while swirling is created in the helical portion B and, in addition, this swirl motion causes a swirl motion of the mixture flowing into the mixture outlet portion 13, as illustrated by the arrow C in FIG. 4. Then, the mixture moves downwards while smoothly swirling along the cylindrical inner wall of the mixture outlet portion 13 and, thus, a strong swirl motion rotating about the helix axis b is created within the mixture outlet portion 13. This swirling mixture flows into the combustion chamber 4 via the valve gap formed between the intake valve 5 and its valve seat.

In FIG. 2, the arrows Q indicate the velocity vector of the mixture flowing into the combustion chamber 4 via the above-mentioned valve gap. The mixture flowing in the inlet passage portion A has an inertia force which causes the mixture to flow along the central axis A of the inlet passage portion A and, in addition, as mentioned above, a part of the mixture flowing in the inlet passage portion A is deflected downwards by the inclined wall portion 16*a*, as illustrated by the arrow L in FIG. 1. As a result of this, the velocity vector Q of the mixture flowing into the combustion chamber 4 along the extension of the central axis a of the inlet passage portion A becomes large, as illustrated in FIG. 2. Consequently, it will be understood that, by arranging the intake port 6 so that the largest velocity vector Q is directed towards the circumferential direction of the combustion chamber 4, it is possible to create the strongest swirl motion in the combustion chamber 4.

In order to arrange the intake port 6 as mentioned above, it is necessary to position the center O of the valve head of the intake valve 5 within the region located above the straight line X on the right side of the straight line Y in FIG. 2 and, in addition, it is necessary to position the inlet end 6*a* below the straight line W in FIG. 2, as mentioned previously. In addition, by forming the inclined wall portion 16*a* as mentioned previously, since a part of the mixture introduced into the inlet passage portion A flows into the mixture outlet portion 13 along the smoothly curved wall 20 without swirling, the flow resistance to which the mixture flowing in the helically-shaped intake port 6 is subjected becomes quite small as compared with that in a conventional helically shaped intake port. As a result of this, a high volumetric efficiency can be ensured when the engine is operating at a high speed under a heavy load.

According to the present invention, it is possible to create a strong swirl motion in the combustion chamber when the engine is operating under a light load, while ensuring a high volumetric efficiency when the engine is operating at a high speed under a heavy load.

While the invention has been described by reference to a specific embodiment chosen for purposes of illustration, it should be apparent that numerous modifications could be made thereto by those skilled in the art without departing from the spirit and scope of the invention.

What is claimed is:

1. A spark-ignition internal combustion engine having a cylinder and a cylinder head which forms a helically-shaped intake port therein and has a substantially vertically extending flat outer side wall, said helically-shaped intake port comprising: a helical portion comprising an open outlet end; an intake valve comprising a head and being arranged at said outlet end, said helical portion being defined by an upper wall and a peripheral side wall which extends circumferentially about an axis of said intake valve; and an elongated inlet passage portion tangentially connected to said helical portion and comprising an open inlet end formed on the outer side wall of the cylinder head, said inlet passage portion being defined by an upper wall, a bottom wall, a first side wall arranged at a position near the axis of said intake valve, and a second side wall arranged at a position remote from the axis of said intake valve and connected to the peripheral side wall of said helical portion, said first side wall comprising an upper portion inclined toward said second side wall, such that the width of said inlet passage portion above the lower edge of the inclined wall portion at any point along said inlet passage portion is narrower than the width of said inlet passage portion below said inclined wall at said point, said inclined wall portion increasing in width in the flow direction until it comprises the entire first side wall at a junction of said inlet passage portion with said helically-shaped intake port, such that the inlet passage portion has a trapezoidal shape at said junction, wherein said inlet passage portion is so arranged that a longitudinal centerline thereof obliquely intersects, at a location between said cylinder and said flat outer side wall of said cylinder head, with a first plane passing through a center of the valve head of said intake valve and extending perpendicular to the outer side wall of the cylinder head, the inlet end of said inlet passage portion being arranged at a position remote from said plane so that said inlet open end does not include said plane, wherein the cylinder has an axis and said inlet passage portion and said intake valve are so arranged that a second plane passing through the axis of the cylinder and extending perpendicular to the outer side wall of the cylinder head is located between the intersection of the centerline of said inlet passage portion with said flat outer side wall of said cylinder head and the center of the valve head of said intake valve, and wherein said helically-shaped intake port further comprises a valve guide projecting into said helical portion from the upper wall of said helical portion and having a circumferential wall, an upper half of the inclined wall portion of said first side wall downstream of said junction being tangentially connected to the circumferential wall of said valve guide, and a lower half of the inclined wall portion of said first side wall downstream of said junction being connected to the peripheral side wall of said helical portion.

2. An internal combustion engine as claimed in claim 1, wherein the second side wall of said inlet passage portion is arranged so as to be substantially vertical.

3. An internal combustion engine as claimed in claim 1, wherein the longitudinal axis of said inlet passage portion is slightly curved.

4. An internal combustion engine as claimed in claim 1, wherein the width of the upper wall of said inlet passage portion is gradually reduced towards said helical portion.

5. An internal combustion engine as claimed in claim 1, wherein the peripheral side wall of said helical portion extends outwards from a periphery of said outlet end.

6. An internal combustion engine as claimed in claim 1, wherein said intake valve is so arranged that the center of the valve head thereof is located between the outer side wall of the cylinder head and a third plane passing through the center of the cylinder and extending in parallel with said outer side wall.

7. An internal combustion engine as claimed in claim 1, wherein the width of said inclined wall portion is gradually increased towards said helical portion.

8. An internal combustion engine as claimed in claim 7, wherein the entire portion of said first side wall is inclined at a position wherein said inlet passage portion is tangentially connected to said helical portion.

9. An internal combustion engine as claimed in claim 1, wherein the width of the upper wall of said helical portion is gradually reduced along the flow direction of intake gas.

10. An internal combustion engine as claimed in claim 9, wherein the upper wall of said helical portion gradually descends towards the flow direction of the intake gas.

11. An internal combustion engine as claimed in claim 1, wherein the outlet end of said helical portion has a cylindrical inner wall extending circumferentially about the axis of said intake valve.

12. An internal combustion engine as claimed in claim 11, wherein the bottom wall of said inlet passage portion is smoothly connected to the inner wall of said outlet end.

13. An internal combustion engine as claimed in claim 12, wherein the width of the bottom wall of said inlet passage portion is gradually reduced towards said helical portion.

* * * * *

UNITED STATES PATENT AND TRADEMARK OFFICE

CERTIFICATE OF CORRECTION

PATENT NO. : 4,406,258

DATED : September 27, 1983

INVENTOR(S) : Setsuro Sekiya, et al

It is certified that error appears in the above—identified patent and that said Letters Patent is hereby corrected as shown below:

Change the Name of the Assignee from"

"Toyota Jidosha K.K." to

--Toyota Jidosha Kogyo Kabushiki Kaisha--

Col. 1, line 61, correct spelling of "inlet".

Signed and Sealed this

*Tenth* Day of *January 1984*

[SEAL]

*Attest:*

GERALD J. MOSSINGHOFF

*Attesting Officer*

*Commissioner of Patents and Trademarks*